United States Patent [19]

Japngie

[11] Patent Number: 4,641,900

[45] Date of Patent: Feb. 10, 1987

[54] TELEPHONE DISTRIBUTION APPARATUS

[75] Inventor: Leonard A. Japngie, Howell, N.J.

[73] Assignee: Telnetix, Inc., Silver Spring, Md.

[21] Appl. No.: 831,178

[22] Filed: Feb. 20, 1986

[51] Int. Cl.[4] ..... H01R 9/09; H01R 25/00

[52] U.S. Cl. ..... 339/17 LC; 339/156 R

[58] Field of Search ..... 339/17 R, 17 C, 17 LC, 339/156 R, 159 R, 159 C, 176 M

[56] References Cited

U.S. PATENT DOCUMENTS 4,392,701 7/1983 Weidler ..... 339/17 R

OTHER PUBLICATIONS

TRW Catalogue CD-12B, Telephone Adapter System, pp. 93-100, 1-1985.

*Primary Examiner*—Neil Abrams

*Attorney, Agent, or Firm*—Donald A. Kettlestrings

[57] ABSTRACT

A telephone distribution apparatus including a housing and a printed circuit board mounted within the housing. The apparatus is configured to enable mounting of the apparatus within small spaces. A first multi-position electrical plug is mounted on the circuit board and in electrical circuit relationship with a plurality of jacks also mounted on the board. The electrical plug and jacks are positioned within openings in the housing to provide a strong, easily assembled compact module for distributing telephone circuits from the multi-position plug to the plurality of jacks.

8 Claims, 6 Drawing Figures

TELEPHONE DISTRIBUTION APPARATUS

This invention relates to telephone distribution apparatus and more particularly to a telephone distribution apparatus for distributing a plurality of telephone circuits from a conventional multi-position electrical plug to a plurality of jacks.

Although various types of telephone adapter systems and telephone distribution devices are known and have served the purpose for which they were designed, they have not proved entirely satisfactory under all conditions of service. For example, many prior art systems have provided for a right angle between cables entering and exiting the systems. Such designs have made it difficult to locate the prior art systems within small spaces, and where such prior art devices have been mounted in areas which subject the devices to pedestrian and user contact, the locations of cable entry and/or exit points of the devices have caused the cables to be exposed to crimping and sometimes failure. A disadvantage of other prior art systems having two-piece housings is that those devices require additional manufacturing steps to assemble the devices.

It is, therefore, an object of the present invention to provide a telephone distribution apparatus which permits easy connection and interchanging of telephone sets.

Another object is to provide such an apparatus which provides for entry and exit of cables to and from the apparatus in substantially parallel relationship with respect to a supporting surface on which the apparatus is mounted so as to enable mounting of the apparatus within small spaces.

A further object of the invention is the provision of such apparatus wherein the housing is constructed to permit the apparatus to be mounted in areas of pedestrian contact and traffic.

Still another object is to provide for such an apparatus which can be removably mounted to a supporting surface.

Yet another object of the present invention is the provision of such an apparatus wherein the housing configuration permits easy assembly of the apparatus.

Still another object is to provide for such an apparatus which is aesthetically pleasing.

Another object is to provide for such an apparatus which provides protection for the internal electrical circuitry.

Another object is to provide for such apparatus which provides a means for removably supporting the apparatus on a surface.

Another object is to provide for such apparatus which provides internal mechanical supports for the electrical circuitry and connectors.

Additional objects and advantages of the invention will be set forth in part by the description which follows, and in part will be obvious from the description, or may be learned by practice of the invention. The objects and advantages are realized and attained by means of the instrumentalities and combinations particularly pointed out in the appended claims.

To achieve these and other objects the present invention provides a telephone distribution apparatus comprising: a housing defining a flat, rectangular, top member having front, rear and side edges; a rear wall member projecting downwardly from the rear edge and defining a lower edge parallel to the rear edge, and an inverted channel-shaped opening in communication with the lower edge; a front wall member projecting downwardly from the front edge and defining a lower edge parallel to the front edge and also defining a plurality of jack-receiving openings; first and second sidewall members projecting downwardly from respective of the side edges and connecting together the front and rear walls; and first and second step-shaped elements projecting outwardly from respective of the side wall members, each of the step-shaped elements defining a plurality of fastener-receiving openings; a printed circuit board defining a plurality of electrically conductive elements in predetermined configurations, the board attached to the step-shaped elements and substantially parallel to the top member; a multi-position electrical plug attached to the board and in electrical circuit relationship with the conductive elements, the plug positioned within the inverted channel-shaped opening; and a plurality of jacks attached to the board and in electrical circuit relationship with the conductive elements, the jacks respectively positioned within the jack-receiving openings.

It is to be understood that both the foregoing general description and the following detailed description are exemplary and explanatory but are not restrictive of the invention.

The accompanying drawings, which are incorporated in and constitute a part of this specification, illustrate an example of a preferred embodiment of the invention and, together with the description, serve to explain the principles of the invention.

Figure 1:
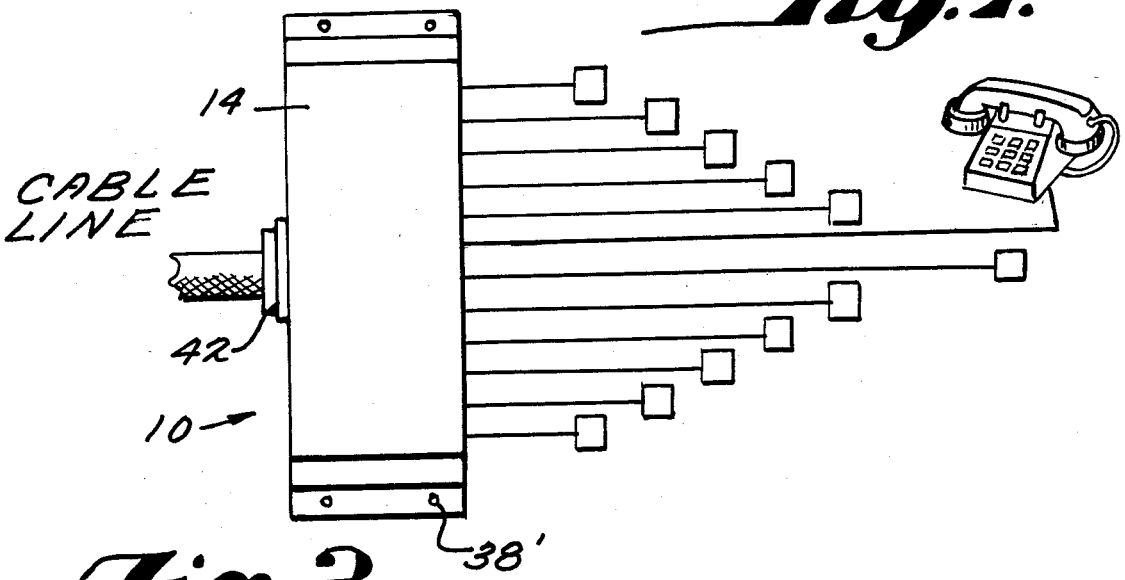
FIG. 1 is a diagrammatic illustration of the apparatus in accordance with this invention and showing its function of distributing a plurality of telephone circuits from a multiposition connector to a plurality of individual jacks to provide voice service for end users.
Figure 2:
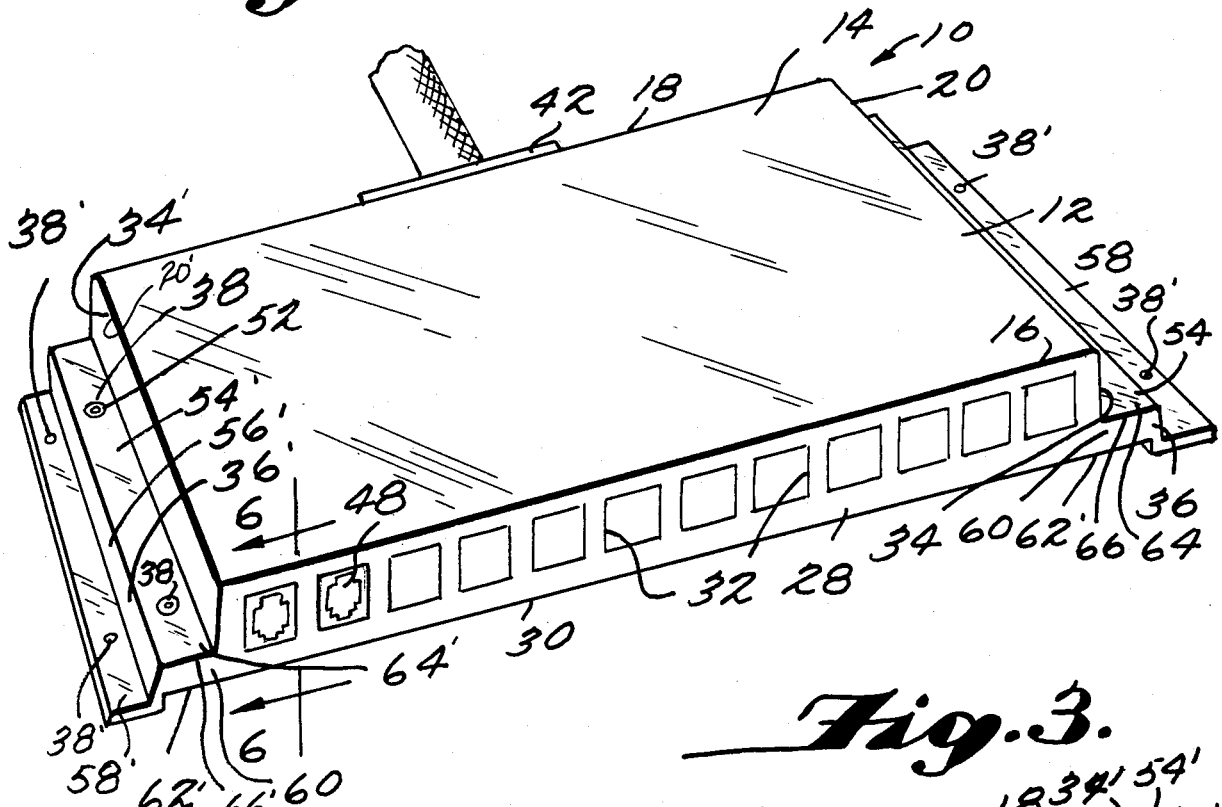
FIG. 2 is a front perspective view of the apparatus.
Figure 3:
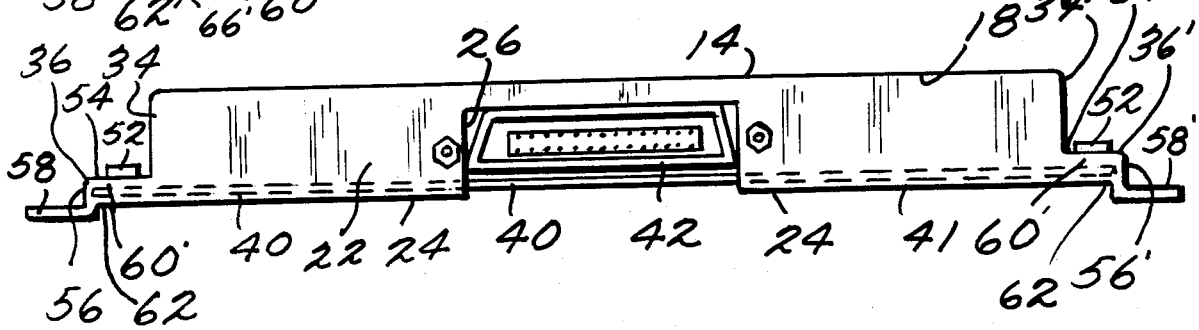
FIG. 3 is a rear elevation view of the apparatus.
Figure 4:
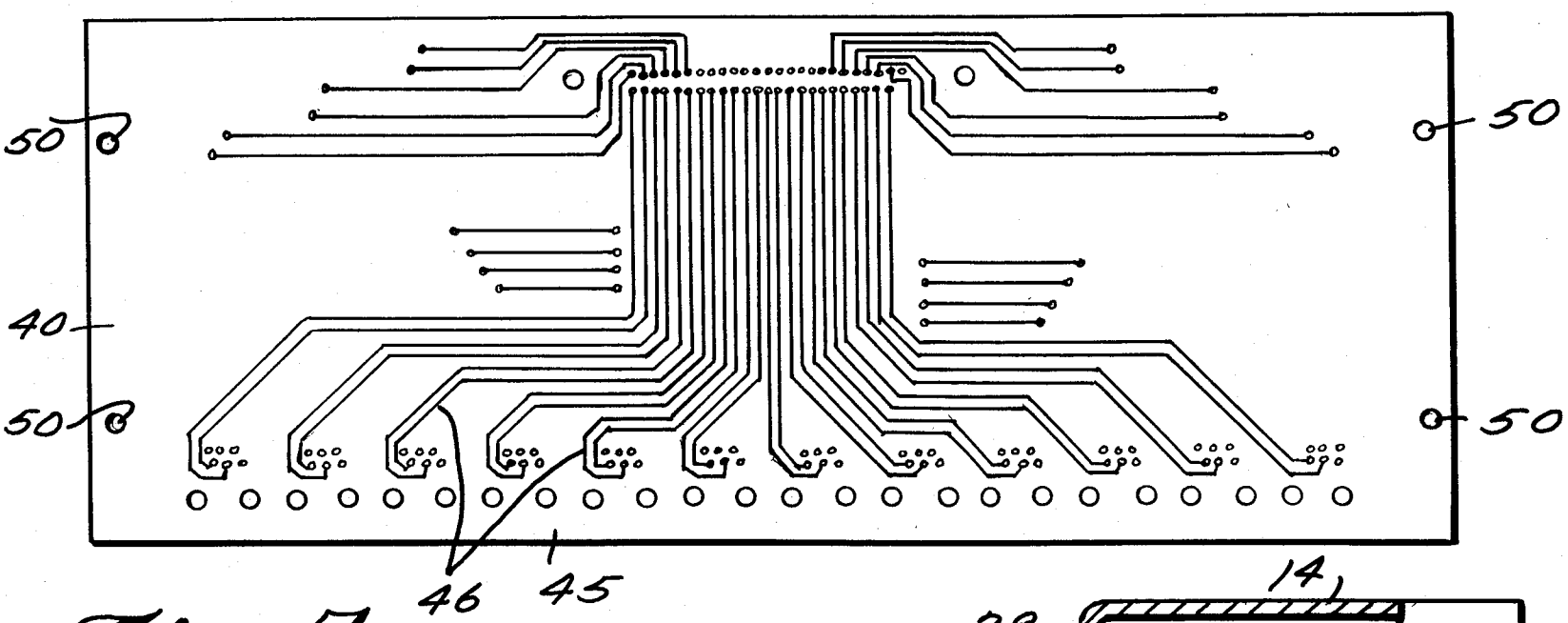
FIG. 4 is a top plan view of the circuit board portion of the apparatus.
Figure 6:
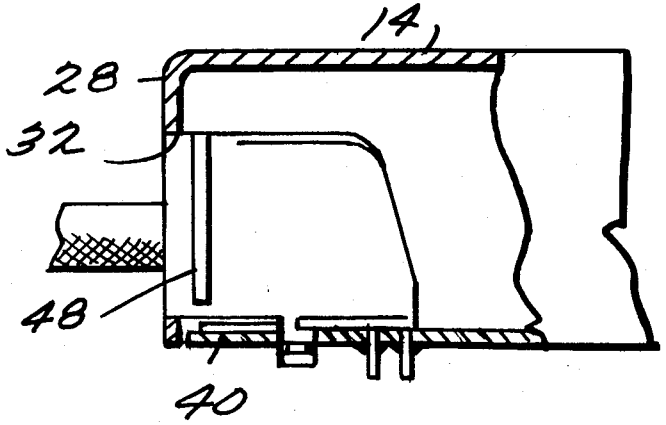
FIG. 6 is a fragmentary sectional view of the apparatus taken along the line 6—6 in FIG. 2 and looking in the direction of the arrows which shows one of the jacks in elevation.
Figure 5:
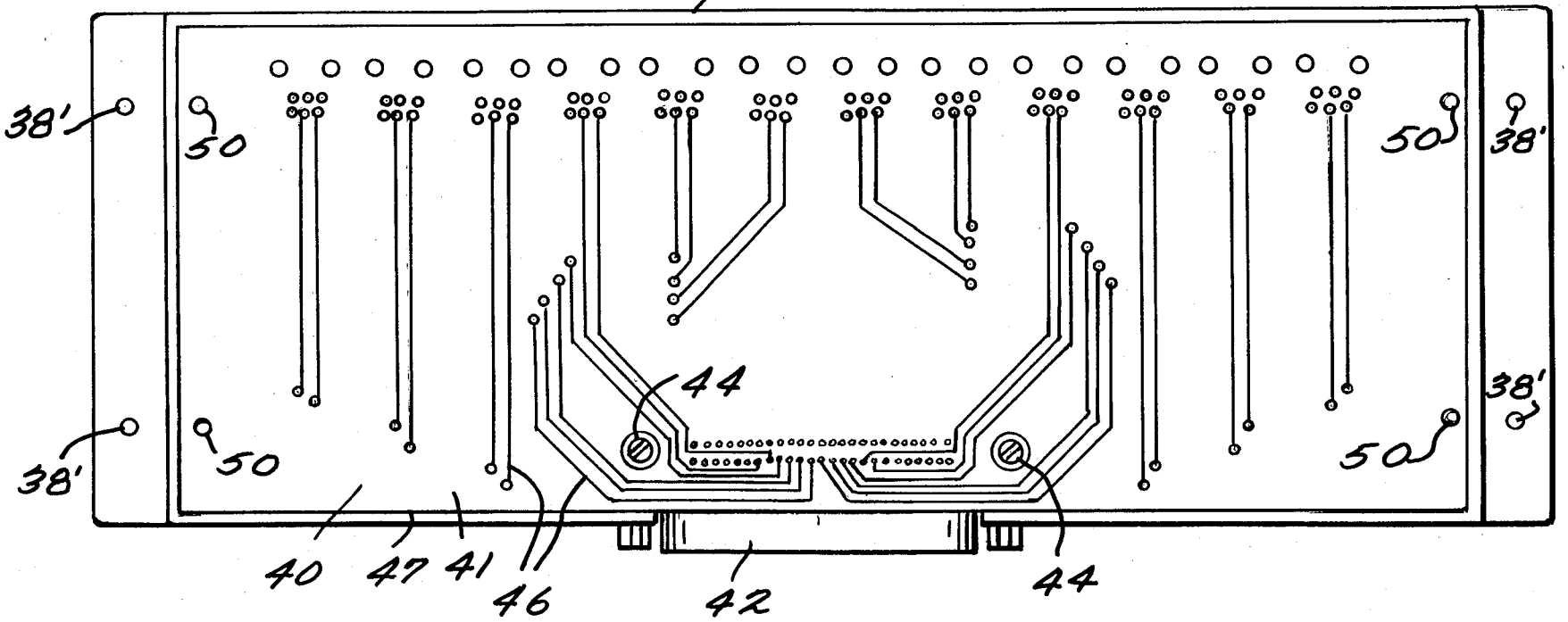
FIG. 5 is a bottom plan view of the apparatus.

With reference now to the drawings, wherein like reference characters designate like or corresponding parts throughout the several views, there is shown telephone distribution apparatus 10. Apparatus 10 includes a housing 12 defining a flat, rectangular, top member 14 having a front edge 16, a rear edge 18 and side edges 20, 20'. A rear wall member 22 projects downwardly from rear edge 18 and defines a lower edge 24 parallel to rear edge 18, and an inverted channel-shaped opening 26 is defined within rear wall member 22 and in communication with lower edge 24.

Housing 12 further includes a front wall member 28 projecting downwardly from front edge 16 and defining a lower edge 30 parallel to front edge 16. Front wall member 28 further defines a plurality of jack-receiving openings 32. Housing 12 further includes first and second side wall members 34, 34' projecting downwardly from respective of side edges 20, 20' and connecting together front wall member 28 and rear wall member 22. First and second step-shaped elements 36, 36' project outwardly from respective of side wall members 34, 34', and each of step-shaped elements 36, 36' defines a plurality of fastener-receiving openings 38, 38'.

In accordance with the invention, apparatus 10 includes a printed circuit board 40 defining a plurality of electrically conductive elements in predetermined configurations, and board 40 is attached to step-shaped elements 36, 36' in substantially parallel relationship to top member 14. A multi-position electrical plug or connector 42, such as an FCC Part 68 standard fifty-position miniature ribbon plug, is attached to the top, rear of board 40 by screws or other conventional fastening elements 44. The electrical elements of plug 42 are connected in conventional electrical circuit relationship with conductive elements 46 of board 40, and plug 42 is positioned within inverted channel-shaped opening 26 of housing 12. A plurality of jacks 48 are conventionally attached to the top of board 40 along a front edge 43 thereof and in conventional electrical circuit relationship with conductive elements 46, and jacks 48 are positioned one each within each of jack-receiving openings 32.

Printed circuit board 40 preferably defines a plurality of apertures 50 therein, and a plurality of fasteners 52, such as rivets or other conventional fasteners, are located within apertures 50 and within predetermined ones of fastener-receiving openings 38 for attaching the printed circuit board to step-shaped elements 36, 36'.

Inverted channel-shaped opening 26 is preferably substantially centered within rear wall member 22, and each of step-shaped elements 36, 36' includes an elongated first flat member 54, 54' respectively, projecting oulwardly and at substantially a right angle from a respective sidewall member 34, 34'. An elongated second flat member 56, 56', respectively, projects downwardly and at substantially a right angle from each first flat member 54, 54', and an elongated third flat member 58, 58', respectively projects outwardly and at substantially a right angle from each second flat member 56, 56'.

Each of step-shaped elements 36, 36' further includes third and fourth side wall members 60, 60' projecting downwardly and at substantially right angles from opposite ends of each of first flat members 54, 54', and each side wall 60, 60' is connected at a substantially right angle to second flat members 56, 56', respectively. Third and fourth side wall members 60, 60' each defines a lower edge 62, 62', respectively, in alignment with respective of said lower edges 24, 30 of rear wall member 22 and front wall member 28.

In accordance with the invention, each first flat member 54, 54' defines an upper surface 64, 64', respectively, and a lower surface 66, 66', respectively, in parallel relationship with upper surfaces 64, 64'. Predetermined ones of fastener-receiving openings 38 are located within first flat member 54, 54'. Preferably, the thickness of printed circuit board 40 is less than the height of third and fourth side wall members 60, 60' so that circuit board 40 is recessed within housing 12, and a lower surface 41 of circuit board 40 is positioned above each of lower edges 24, 30, 62, 62'. Third flat members 58, 58' each define additional ones 38' of fastener-receiving openings for removably receiving additional fasteners, such as screws or the like, to removably attach apparatus 10 to a supporting surface.

The design and configuration of housing 12 and the use of circuit board 40 simplifies assembly of apparatus 10. In the assembly process plug 42 and jacks 48 are first mounted onto circuit board 40 in a conventional manner. The electrical elements of plug 42 and of jacks 48 are conventionally connected in electrical circuit relationship with conductive elements 46 of board 40. This assembly is then positioned adjacent to housing 12 with side 45 of circuit board 40 on which plug 42 and jacks 48 are mounted oriented toward the interior of housing 12. Circuit board 40 is then positioned with jacks 48 aligned with respective of jack-receiving openings 32. The circuit board is then moved so that jacks 48 are inserted into their respective jack-receiving openings 32 while keeping the rear part 47 of circuit board 40 and electrical plug 42 positioned below lower edge 24. Rear portion 47 of circuit board 40 and plug 42 are then rotated toward the interior of housing 12 with plug 42 positioned within inverted channel-shaped opening 26. Fasteners 52, such as rivets or other conventional fasteners, are used together with fastener-receiving openings 38 and circuit board apertures 50 for attaching circuit board 40 to housing 12 and to step-shaped elements 36, 36'.

In operation and use of apparatus 10 the apparatus is attached to a supporting surface by inserting fasteners through openings 38'. Apparatus 10 can be removably mounted onto horizontal, vertical or inverted surfaces. Multi-position plug 42 is removably connected to an FCC standard fifty-position RJ23X connector which typically contains twelve four-wire telephone circuits that provide voice service for end users. Conductive elements 46 of circuit board 40 distribute each four-wire circuit to individual ones of jacks 48 in the front of apparatus 10. Jacks 48 preferably conform to FCC standard USOC RJ13X. Jacks 48 can be removably connected to industry standard plugs (not shown) which are connected to individual telephone units.

By use of apparatus 10, users can connect into and change any of a plurality of telephone circuits within apparatus 10 by simply plugging each individual telephone into a different jack 48. Apparatus 10 is illustrated with twelve jacks 48 to accomodate a standard fifty wire trunk cable which contains twelve four-wire circuits.

The size and configuration of apparatus 10 enables the apparatus to be utilized in very small spaces. For example, because of the configuration of the apparatus whereby cables enter the front of the apparatus and exit at the rear of the apparatus, and because of the depth of housing 12, apparatus 10 can be mounted in spaces where room is limited to as little as 1.33 inches above a mounting surface. This enables apparatus 10 to be mounted in spaces behind desks, file cabinets and other office furniture and even on the office floor. The structure and strength of apparatus 10 also enables it to be used in areas of pedestrian traffic without danger of damage. Apparatus 10 can be removably mounted onto supporting surfaces at any angle or orientation, and the configuration and structure of housing 12 enables quick and inexpensive assembly of apparatus 10.

The invention in its broader aspects is not limited to the specific details shown and described, and departures may be made from such details without departing from the principles of the invention and without sacrificing its chief advantages.

What is claimed is:

1. A telephone distribution apparatus comprising:

a housing defining a flat rectangular, top member having front, rear and side edges; a rear wall member projecting downwardly from said rear edge and defining a lower edge parallel to said rear edge and an inverted channel-shaped opening in communication with said lower edge; a front wall member projecting downwardly from said front edge and defining a lower edge parallel to said front edge and a plurality of jack-receiving openings; first and second side wall members projecting downwardly from respective of said side edges and connecting together said front and rear wall members; and first and second step-shaped elements projecting outwardly from respective of said side wall members, each of said step-shaped elements defining a plurality of fastener-receiving openings;

a printed circuit board defining a plurality of electrically conductive elements in predetermined configurations, said board attached to said step-shaped elements and substantially parallel to said top member;

a multi-position electrical plug attached to said board and in electrical circuit relationship with said conductive elements, said plug positioned within said inverted channel-shaped opening; and a plurality of jacks attached to said board and in electrical circuit relationship with said conductive elements, said jacks respectively positioned within said jack-receiving openings.

2. Apparatus as in claim 1 wherein said printed circuit board defines a plurality of apertures therein; and a plurality of fasteners located within said apertures and within predetermined ones of said fastener-receiving openings for attaching said printed circuit board to said step-shaped elements.

3. Apparatus as in claim 2 wherein said inverted channel-shaped opening is substantially centered within said rear wall member.

4. Apparatus, as in claim 3 wherein each of said step-shaped elements includes an elongated first flat member projecting outwardly and at substantially a right angle from said side wall member; an elongated second flat member projecting downwardly and at substantially a right angle from said first flat member; and an elongated third flat member projecting outwardly and at substantially a right angle from said second flat member.

5. Apparatus as in claim 4 wherein each of said step-shaped elements further includes third and fourth side wall members projecting downwardly and at substantially right angles from opposite ends of said first flat member and connected at a substantially right angle to said second flat member, said third and fourth side wall members each defining a lower edge in alignment with respective of said lower edges of said rear wall member and said front wall member.

6. Apparatus as in claim 5 wherein each of said first flat members defines upper and lower parallel surfaces, and wherein said predetermined ones of said fastener-receiving openings are located within said first flat members.

7. Apparatus as in claim 6 wherein the thickness of said printed circuit board is less than the height of said third and fourth side wall members whereby said printed circuit board is recessed within said housing and a lower surface of said printed circuit board is positioned above each of said lower edges.

8. Apparatus as in claim 7 wherein said third flat members each define additional ones of said fastener-receiving openings for removably receiving additional fasteners to removably attach said apparatus to a supporting surface.

* * * * *